US008655250B2

(12) United States Patent
Brewington et al.

(10) Patent No.: US 8,655,250 B2
(45) Date of Patent: Feb. 18, 2014

(54) APPARATUS AND METHOD FOR MARKING MATERIAL FIX LEVEL CONTROL IN A PRINTING APPARATUS

(75) Inventors: Grace T. Brewington, Fairport, NY (US); Anthony S. Condello, Webster, NY (US); Frank J. Bonsignore, Rochester, NY (US); Christopher Lynn, Wolcott, NY (US); John Newell, Fairport, NY (US); Phillip Crispino, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 411 days.

(21) Appl. No.: 13/077,158

(22) Filed: Mar. 31, 2011

(65) Prior Publication Data

US 2012/0251152 A1 Oct. 4, 2012

(51) Int. Cl.
*G03G 15/20* (2006.01)

(52) U.S. Cl.
USPC ..... 399/341; 399/67; 399/320

(58) Field of Classification Search
USPC ..... 399/67, 320, 341
See application file for complete search history.

(56) References Cited

U.S. PATENT DOCUMENTS

| | | | | |
|---|---|---|---|---|
| 6,477,895 | B2 * | 11/2002 | Lawson et al. | 73/150 R |
| 2003/0073017 | A1 * | 4/2003 | Fields et al. | 430/108.1 |
| 2004/0142262 | A1 * | 7/2004 | Nakamura et al. | 399/336 |
| 2005/0208403 | A1 * | 9/2005 | Shu et al. | 430/108.1 |
| 2009/0046290 | A1 * | 2/2009 | Silva | 356/432 |

OTHER PUBLICATIONS

Jordan Wosnick et al.; "Toner Processes"; U.S. Appl. No. 12/871,152, filed Aug. 30, 2010.
Dale R. Mashtare; "Multi-Stage Fixing Systems, Printing Apparatuses and Methods of Fixing Marking Material to Substrates"; U.S. Appl. No. 12/855,011, filed Aug. 12, 2010.

* cited by examiner

*Primary Examiner* — Ryan Walsh
(74) *Attorney, Agent, or Firm* — Ronald E. Prass, Jr.; Prass LLP

(57) ABSTRACT

An apparatus and method control fix levels in a printing apparatus. The apparatus can include a media transport configured to transport a media sheet having marking material on at least a first side of the media sheet. The apparatus can include a media sheet rub module configured to rub a rub material against the first side of the media sheet. The apparatus can include a sensor configured to sense marking material on the rub material, the marking material rubbed from the first side of the media sheet onto the rub material. The apparatus can include a controller configured to determine a fix level of marking material on the media sheet based on the sensed marking material on the rub material, the fix level indicating how well the marking material is affixed to the media sheet.

16 Claims, 6 Drawing Sheets

APPARATUS AND METHOD FOR MARKING MATERIAL FIX LEVEL CONTROL IN A PRINTING APPARATUS

BACKGROUND

Disclosed herein is an apparatus and method that controls fix levels in a printing apparatus.

Presently, image output devices, such as printers, multifunction media devices, xerographic machines, ink jet printers, flexographic printing machines, lithographic printing machines, and other devices produce images on media sheets, such as paper, substrates, transparencies, plastic, labels, or other media sheets. To produce an image, marking material, such as toner, ink jet ink, or other marking material, is applied to a media sheet to create a marking material latent image on the media sheet. A fuser assembly then affixes or fuses the marking material latent image to the media sheet by applying heat and/or pressure to the media sheet.

Fuser assemblies apply pressure using rotational members, such as fuser rolls or belts, that are coupled to each other at a fuser nip. Pressure is applied to the media sheet with the marking material latent image as the media sheet is fed through the fuser nip to affix the marking material to the media sheet.

Unfortunately, in many electrophotographic systems, a failure mode occurs when marking material is not adequately fixed to the media sheet. These failures are associated with batch-to-batch variations in manufactured marking material, variations in manufactured media, and other factors. One countermeasure is to select fuser setpoints to handle the worse inputs. Another countermeasure is to allow operator input on the media type to enable the control system to select improved fuser setpoints, for example, higher fusing temperature for heavy weight media. However, these countermeasures are inefficient and do not consistently maintain adequate fix level performance in the field.

Thus, there is a need for an apparatus and method that controls fix levels in a printing apparatus.

SUMMARY

An apparatus and method that controls fix levels in a printing apparatus is disclosed. The apparatus can include a media transport configured to transport a media sheet having marking material on at least a first side of the media sheet. The apparatus can include a media sheet rub module configured to rub a rub material against the first side of the media sheet. The apparatus can include a sensor configured to sense marking material on the rub material, the marking material rubbed from the first side of the media sheet onto the rub material. The apparatus can include a controller configured to determine a fix level of marking material on the media sheet based on the sensed marking material on the rub material, the fix level indicating how well the marking material is affixed to the media sheet. The controller can include closed loop control of the fusing assembly to update a setpoint on an actuator.

BRIEF DESCRIPTION OF THE DRAWINGS

In order to describe the manner in which advantages and features of the disclosure can be obtained, a more particular description of the disclosure briefly described above will be rendered by reference to specific embodiments thereof, which are illustrated in the appended drawings. Understanding that these drawings depict only typical embodiments of the disclosure and do not limit its scope, the disclosure will be described and explained with additional specificity and detail through the use of the drawings in which.

DETAILED DESCRIPTION

Figure 1:
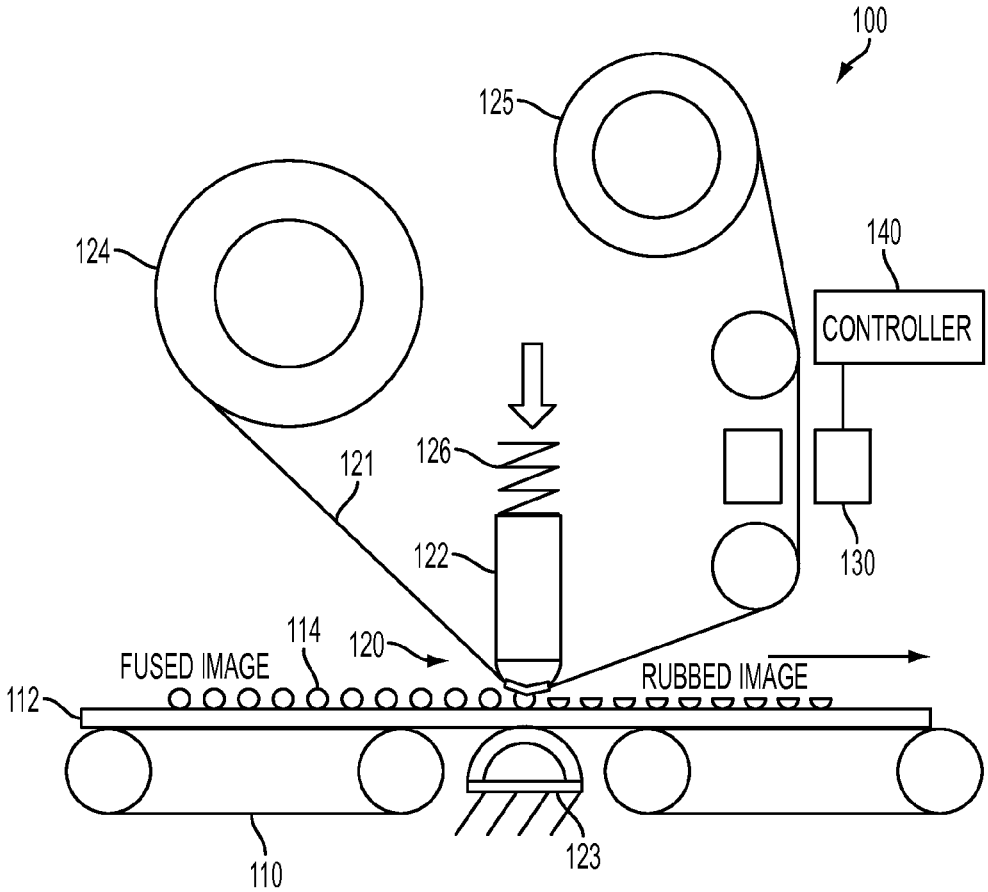
FIG. 1 is an example illustration of an apparatus.

The embodiments include an apparatus that controls fix levels in a printing apparatus. The apparatus can include a media transport configured to transport a media sheet having marking material on at least a first side of the media sheet. The apparatus can include a media sheet rub module configured to rub a rub material against the first side of the media sheet. The apparatus can include a sensor configured to sense marking material on the rub material, the marking material rubbed from the first side of the media sheet onto the rub material. The apparatus can include a controller configured to determine a fix level of marking material on the media sheet based on the sensed marking material on the rub material, the fix level indicating how well the marking material is affixed to the media sheet. The controller can include closed loop control of the fusing assembly to update a setpoint on an actuator.

The embodiments further include method that controls fix levels in an apparatus. The apparatus can have a media transport, a media sheet rub module, and a sensor. The method can include transporting a media sheet on the media transport, the media sheet having marking material on at least a first side of the media sheet. The method can include rubbing a rub material against the first side of the media sheet using the media sheet rub module. The method can include sensing marking material on the rub material using the sensor, the marking material rubbed from the first side of the media sheet onto the rub material. The method can include determining a fix level of marking material on the media sheet based on the sensed marking material on the rub material, the fix level indicating how well the marking material is affixed to the media sheet. The method can include closed loop control of the fusing assembly to update a setpoint on an actuator.

The embodiments further include a printing apparatus that controls fix levels. The printing apparatus can include a media transport configured to transport a media sheet. The printing apparatus can include an image generation module, such as a marking module, configured to generate an image by placing marking material on at least a first side of the media sheet. The printing apparatus can include an image affixing module, such as a fusing module, configured to affix at least a portion the marking material to the first side of the media sheet. The printing apparatus can include a media sheet rub module configured to rub a rub material against the first side of the media sheet containing marking material. The printing apparatus can include a sensor configured to sense marking material on the rub material, the marking material rubbed from the first side of the media sheet onto the rub material. The printing apparatus can include a controller configured to determine a fix level of marking material on the media sheet based on the sensed marking material on the rub material, the fix level indicating how well the marking material is affixed to the media sheet. The controller can include closed loop control of the fusing assembly to update a setpoint on an actuator.

Figure 2:
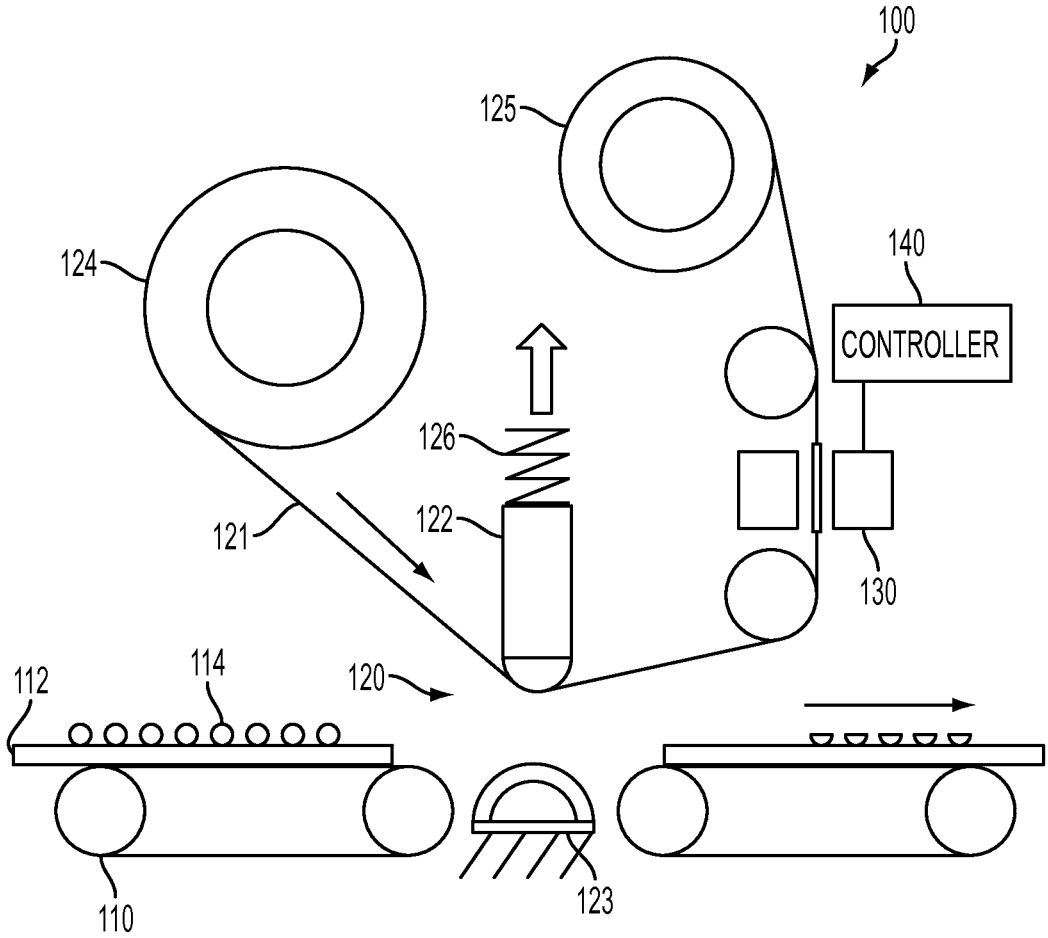
FIG. 2 is an example illustration of an apparatus.

FIG. 1 and FIG. 2 are example illustrations of an apparatus 100, such as an electrostatographic printing apparatus, a xerographic printing apparatus, a flexographic printing apparatus, a lithographic printing apparatus, or any other apparatus that generates an image on media. The apparatus 100 may also be part of a printer, a multifunction media device, a xerographic machine, a laser printer, or any other device that generates an image on media.

The apparatus 100 can include a media transport 110 configured to transport a media sheet 112 having marking material 114 on at least a first side of the media sheet 112. The marking material 114 can be toner, ink-jet ink, lithographic ink, flexographic ink, or any other marking material.

The apparatus 100 can include a media sheet rub module 120 configured to rub a rub material 121 against the first side of the media sheet 112. The rub material 121 can be cloth, paper, or any other material that can rub unfixed marking material off a media sheet. The media sheet rub module 120 can include a backing apparatus 122 coupled to an opposite side of the rub material 121 from the media sheet 112. The backing apparatus 122 can selectively engage the rub material 121 with media sheets and disengage the rub material 121 from media sheets. For example, the media sheet rub module 120 can include an actuator 126 that engages (FIG. 1) and disengages (FIG. 2) the rub material 121 with media sheets. The media sheet rub module 120 can include a backing structure 123 that provides support for the media sheet 112 when the backing apparatus 112 exerts pressure on the media sheet 112. The media sheet rub module 120 can include rollers 124 and 125 that can feed and receive the rub material 121.

The apparatus 100 can include a sensor 130 configured to sense marking material on the rub material 121, the marking material rubbed from the first side of the media sheet 112 onto the rub material 121. The sensor 130 can be a densitometer, a full width array sensor, a spectrophotometer, an image scan bar, or any other sensor that can sense marking material. For example, a densitometer used as a sensor in experiments can output a level of 255 for completely white and can output lower levels for darker or grayer readings. A clean cloth reading in the experiments was typically 245. The rubbed cloth reading can be lower than the clean cloth reading because the rubbed cloth can be darker from marking material that is rubbed off a substrate. The rubbed cloth reading can be subtracted from the clean cloth reading to obtain a linear rub level.

The apparatus 100 can include a controller 140 that can determine a fix level of marking material 114 on the media sheet 112 based on the sensed marking material on the rub material 121, where the fix level can indicate how well the marking material 114 is affixed to the media sheet 112. For example, the controller 140 can determine a fix level of marking material 114 on the media sheet 112 based on a difference between a value corresponding to the sensed marking material on the rub material 121 and a value corresponding to the rub material 121 without marking material. The controller 140 can determine a fix level of marking material 114 on the media sheet 112 by determining a difference between a value corresponding to the sensed marking material on the rub material 121 and a value corresponding to the rub material 121 without marking material and by comparing the difference to a threshold.

The sensor 130 can sense a characteristic of the rub material 121 without marking material. The controller 140 can determine a fix level of marking material 114 on the media sheet 112 based on a difference between a value corresponding to the sensed marking material on the rub material 121 and a value corresponding to the sensed characteristic of rub material 121 without marking material. For example, the sensor 130 can sense a level of unrubbed whiteness of rub material 121 without marking material and output a value of unrubbed whiteness. The sensor 130 can then sense a level of rubbed whiteness based on marking material on the rub material 121 rubbed from the first side of the media sheet 112 and output a value of rubbed whiteness. The controller 140 can determine a fix level of marking material 114 on the media sheet 112 based on a difference between the value of unrubbed whiteness and the value of rubbed whiteness.

The controller 140 can determine at least one updated setpoint of at least one actuator in a printing apparatus based on the fix level of marking material 114 on the media sheet 112. Examples of actuators can include fuser roll temperature, pressure roll temperature, fuser nip pressure, nip dwell time (process speed), and/or other actuators. As other examples, for systems where there is preheat prior to a fuser nip, such as convective preheat, additional actuators can be air temperature, flow rate, height of the impinging jet, and/or other actuators. The controller 140 can adjust at least one actuator setpoint based on the at least one updated setpoint. As an alternative, the controller 140 can output the fix level of marking material and/or the updated setpoint. For example, the process can be performed offline from a printing apparatus and values can be output to a user, on a removable memory, over a network, or otherwise output to provide information for adjusting actuator setpoints or other elements of a printing apparatus. The controller 140 can also output a warning signal if marking material 114 is insufficiently affixed to the media sheet 112.

For example, the apparatus 100 can be an in-line fix level subsystem. Fused prints can be passed under a stylus, such as the backing apparatus 122, which can be covered with rub material 121, such as a standard cloth material. The stylus 122 can be engaged for the stylus 122 and cloth 121 to apply a standard pressure on a fused image on the media sheet 112. In one embodiment, the stylus 122 can be stationary in the process direction and the fused print can be moved under the stylus 122 and cloth 121. Toner or ink can accumulate on the cloth 121 if the image is not adequately fused. After rubbing the print for a standard length, the stylus 122 can be retracted out of contact. The cloth 121 web section which was in contact with the print can be advanced to the sensor 130 reading position. The sensor 130 can read the gray level of the rubbed cloth 121 and can communicate the reading to the controller 140. The difference between the cloth gray level and the clean cloth gray level is a function of the amount of toner or ink rubbed off the print.

According to one example embodiment, the stylus pressure can be defined by a 500 gram weight applied to the stylus 122 which can have an area of 0.27 square inches. Four linear inches of 50% halftone image can be rubbed by the stylus 122 and cloth 121. The controller 140 can receive the gray level reading from the sensor 130, can compare the value to the acceptable level, and, if the gray level reading is not acceptable, can run an algorithm to determine updated setpoints on one or more of the actuators. The updated setpoints can be executed by the controller 140 in combination with apparatus controls. Examples of actuators can include fuser roll temperature, pressure roll temperature, fuser nip pressure, and nip dwell time, which can be based on process speed. For systems where there is preheat prior to the fuser nip, such as convective preheat, additional actuators can include air temperature, flow rate, height of an impinging jet.

Figure 3:
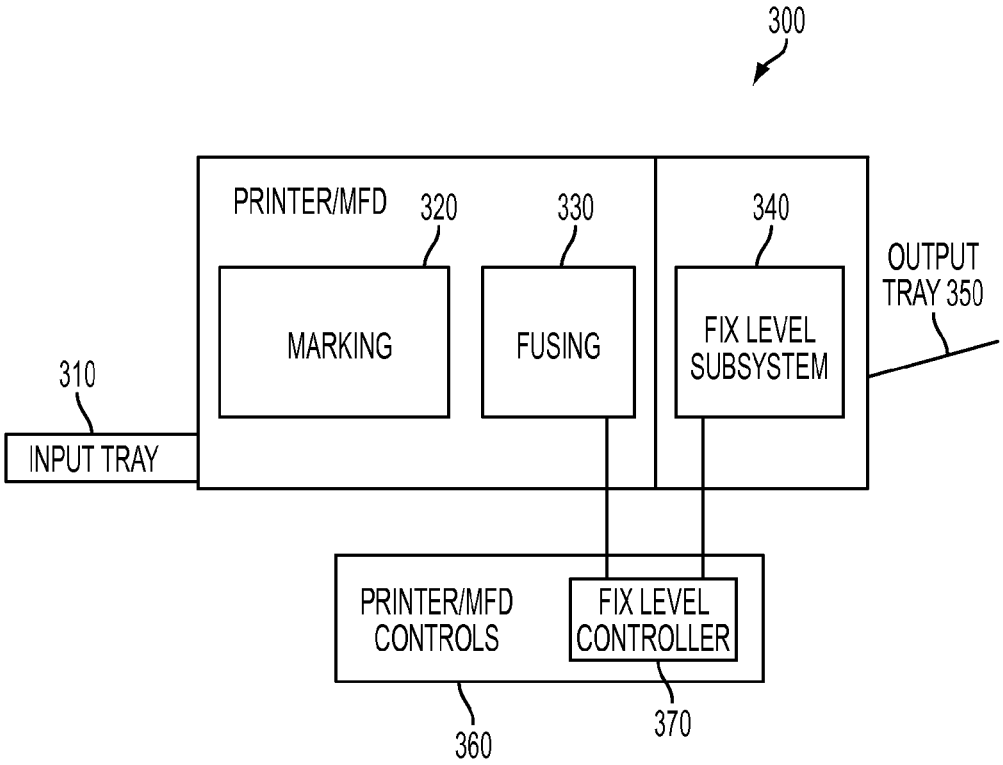
FIG. 3 is an example illustration of a printing apparatus.

FIG. 3 is an example illustration of a printing apparatus 300. The printing apparatus 300 can include an input tray 310 that can feed media sheets through the printing apparatus 300.

The printing apparatus 300 can include a marking module 320 that can mark marking material onto media sheets. The printing apparatus 300 can include a fusing module 330 that can affix marking material onto the media sheets. The printing apparatus 300 can include a fix level subsystem 340. The fix level subsystem 340 can include the elements of the apparatus 100. The printing apparatus 300 can include a printing apparatus controller 360 that can include a fix level controller 370. The fix level controller 370 can include the controller 140 and can perform the process operations disclosed in the embodiments. The printing apparatus 300 can include an output tray 350 that can receive media sheets fed through the printing apparatus 300.

For example, the printing apparatus 300, such as a multifunction device, can incorporate the apparatus 100 as a fix level subsystem 340 incorporated inline into the media path after the fuser 330 and before the output tray 350. Data from the fix level subsystem 340 can be processed by the fix level controller 370. The fix level controller 370 can determine whether a test image on a media sheet displays adequate fix level. For cases where fix level fails, the fix level controller 370 can determine new setpoints for printing apparatus actuators. In conjunction with the printing apparatus controller 360, the fuser setpoints or other setpoints in the printing apparatus 300 can be changed in response to the fix level controller 370.

Figure 4:
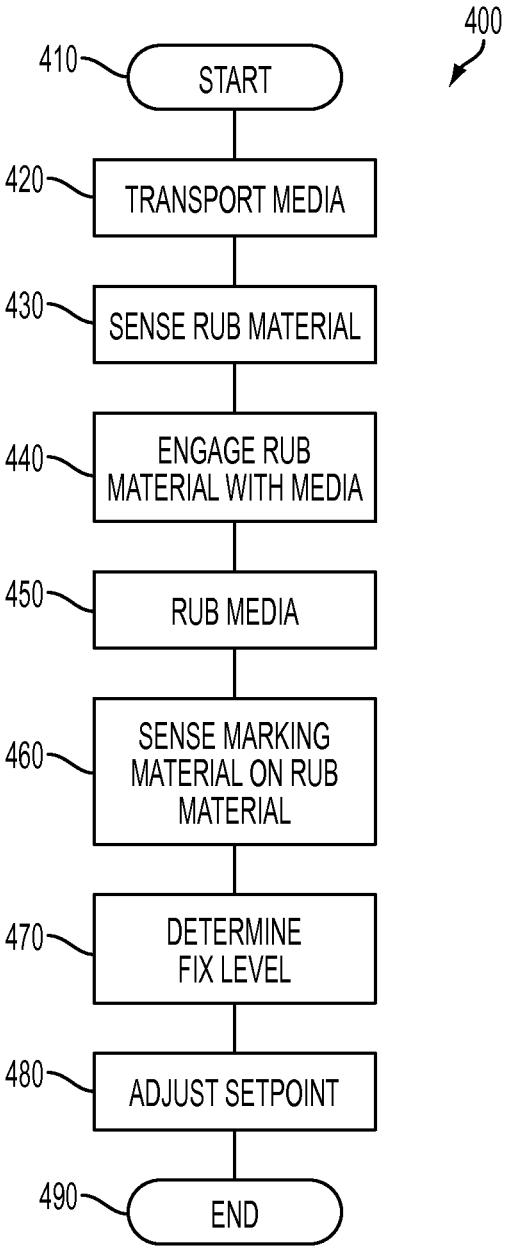
FIG. 4 illustrates an example flowchart of a method of controlling fix levels in a printing apparatus.

FIG. 4 illustrates an exemplary flowchart 400 of a method of controlling fix levels in a printing apparatus. The printing apparatus can have a media transport configured to transport a media sheet. The printing apparatus can have a media sheet rub module including rub material. The printing apparatus can have a sensor. The printing apparatus can also have backing apparatus coupled to an opposite side of the rub material from the media sheet.

The method can start at 410. At 420, the media sheet can be transported on the media transport. The media sheet can have marking material on at least a first side of the media sheet. At 430, the sensor can sense a characteristic of rub material without marking material. For example, the sensor can sense a level of unrubbed whiteness of rub material without marking material before the media sheet contacts the rub material and can output a value of unrubbed whiteness.

At 440, the rub material can be engaged with the media sheet. The rub material can be selectively engaged with, and disengaged from, media sheets using the backing apparatus. At 450, the media sheet rub module can rub a rub material against the first side of the media sheet. At 460, the sensor can sense marking material on the rub material, where the marking material has been rubbed from the first side of the media sheet onto the rub material. For example, the sensor can sense a level of rubbed whiteness based on marking material on the rub material rubbed from the first side of the media sheet and can output a value of rubbed whiteness.

At 470, a fix level of marking material on the media sheet can be determined based on the sensed marking material on the rub material. The fix level can indicate how well the marking material is affixed to the media sheet. The fix level of marking material on the media sheet can be determined based on a difference between a value corresponding to the sensed marking material on the rub material and a value corresponding to the rub material without marking material. The fix level of marking material on the media sheet can be determined by determining a difference between a value corresponding to the sensed marking material on the rub material and a value corresponding to the rub material without marking material and by comparing the difference to a threshold. The fix level of marking material on the media sheet can also be determined based on a difference between a value corresponding to the sensed marking material on the rub material and a value corresponding to the sensed characteristic of rub material without marking material. The fix level of marking material on the media sheet can also be determined based on a difference between the value of unrubbed whiteness and the value of rubbed whiteness. At least one updated setpoint of at least one actuator in a printing apparatus can be determined based on the fix level of marking material on the media sheet. The at least one actuator setpoint can be adjusted based on the at least one updated setpoint.

According to some embodiments, all of the blocks of the flowchart 400 are not necessary. Additionally, the flowchart 400 or blocks of the flowchart 400 may be performed numerous times, such as iteratively. For example, the flowchart 400 may loop back from later blocks to earlier blocks. Furthermore, many of the blocks can be performed concurrently or in parallel processes.

Figure 5:
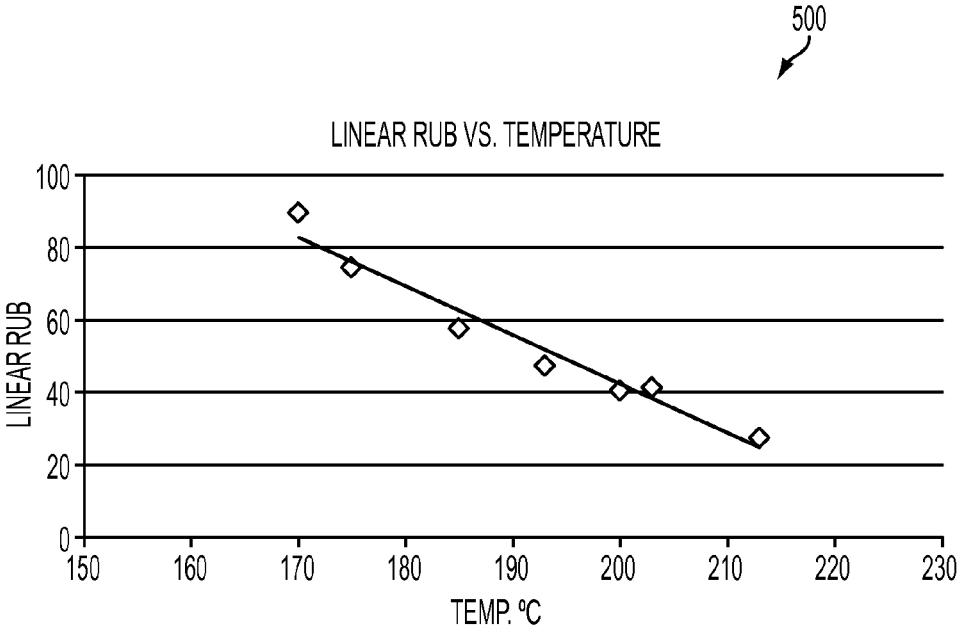
FIG. 5 is an example graph illustrating linear rub vs. fuser nip temperature.

FIG. 5 is an example graph 500 illustrating linear rub vs. fuser nip temperature for a commercial office printer. Lower numbers are better. For example, the rub data can be represented as gray level of white cloth minus gray level of rubbed cloth, so a lower rub value can translate to a whiter cloth appearance and less toner or ink on the cloth corresponding to a better fixed image on a media sheet. As an example, acceptable performance can be chosen as linear rub level of 40 units or less. This data illustrates that temperature can be used as an actuator to improve fix level measured by the apparatus and process described in the embodiments.

Figure 6:
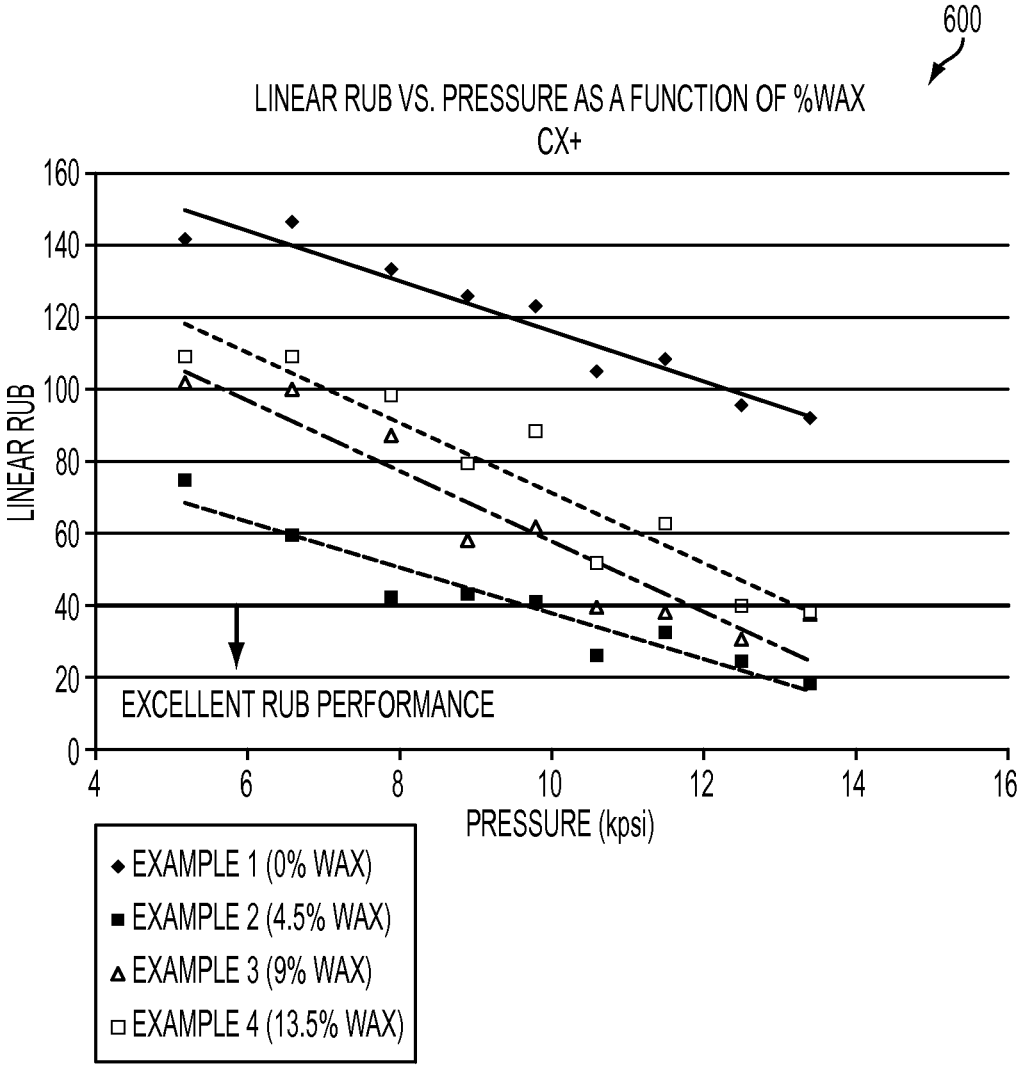
FIG. 6 is an example graph illustrating linear rub vs. pressure for prints.

FIG. 6 is an example graph 600 illustrating linear rub vs. pressure for prints from cyan polyester toners containing FXC-42, 0% to 13.5% wax, and 28% FXC-42 shell. Lower numbers can be better, and the acceptable performance can be chosen as, for example, linear rub level of 40 units or less. This data illustrates that pressure can be used as an actuator to improve fix level measured by the apparatus and process described in the embodiments.

Embodiments can provide an apparatus and process for fix level control. The apparatus can be in-line in the printer, near-line, or off-line. The amount of toner remaining on a cloth substrate that has been rubbed across a target halftone area on a diagnostic print can be measured with a densitometer. Toner that is not well fixed can be removed from the print by the cloth. The densitometer rub data can be fed into a fix level controller and compared with the maximum acceptable level. The fix level controller, in combination with the printer controls, can change fuser setpoints to achieve adequate fix. Examples of fix level controller actuators can include fuser temperature, pressure, and process speed for dwell time.

Embodiments can provide an in-line fix level subsystem. Embodiments can also provide a fix level subsystem that can be near-line with automated or manual feeding of test images and automated or manual operations to feed the data to a fix level controller. Embodiments can also provide for a fix level subsystem that can be off-line with automated or manual feeding of test images and automated or manual operations to feed the data to a fix level controller. Embodiments can accommodate different sensors and can be capable of measurements with color toners or inks. For a sensor that reads 24 bit color, the green channel can be used for black toner or ink images. The red channel can be used for cyan toner or ink images. The green channel can be used for magenta toner or ink. The blue channel can be used for yellow toner or ink. Embodiments can be used in cut sheet or web feed systems.

For example, a level of cohesion of toner particles can be measured using a linear rub test. In this test, after toner is fixed to a substrate to produce a print, a stylus covered with a selected cloth material can be rubbed on the print. The stylus pressure can be given by the ratio of the known stylus weight to the known stylus area over which the weight is applied. The stylus can be moved a known distance over the print. In this test, toner can accumulate on the cloth for prints where the toner image is not completely fixed or fused on the substrate. After rubbing the print, the cloth can be scanned with a sensor such as a scanner and the difference between the average gray level of the rubbed cloth and the gray level of a clean cloth can be reported as the linear rub number. A lower linear rub number can indicate better fixing or fusing of toner to a substrate. In an example embodiment of the linear rub test, the stylus weight can be 500 grams, the stylus area can be 0.27 $in^2$ and the stylus can moved 4 inches over the imaged surface of the print. For this embodiment of the linear rub test, it can be desirable for prints to have less than a maximum linear rub number of about 60, such as less than 50, less than 40, less than 30, or less than 20. For an example embodiment, a linear rub number of less than about 40 indicates an excellent fix level of toner to a substrate. A linear rub level of 40-60 can indicate an excellent to good fix level of toner to a substrate and higher linear rub level numbers can indicate a poor fix. Different implementations can use different sensors and/or can result in different clean cloth readings, different rubbed cloth readings, and/or different desirable linear rub levels.

Embodiments can allow for a window of predetermined acceptable fix. Actuator and fix values can include appropriate factor of safety to threshold levels. The values can relate to media, batch of toner, humidity, roll age, and other factors. Embodiments can allow for greater range of tolerances of elements while still having maximum or minimum levels. For example, fuser temperature may be low, but a good fix may still be shown by the rub process. Thus, embodiments can allow for low temperature level if a good fix is still being achieved.

Although the above description is directed toward a fuser used in xerographic printing, it will be understood that the teachings and claims herein can be applied to any treatment of marking material on a medium. For example, the marking material may comprise toner, liquid or gel ink, lithographic ink, flexographic ink, and/or heat- or radiation-curable ink; and/or the medium itself may have certain requirements, such as temperature, for successful printing. The heat, pressure and other conditions required for treatment of the ink on the medium in a given embodiment may be different from those suitable for xerographic fusing. As used herein, any such marking material-to-media affixation processing shall be considered "fusing," regardless of its exact nature.

Embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The term "coupled," unless otherwise modified, implies that elements may be connected together, but does not require a direct connection. For example, elements may be connected through one or more intervening elements. Furthermore, two elements may be coupled by using physical connections between the elements, by using electrical signals between the elements, by using radio frequency signals between the elements, by using optical signals between the elements, by providing functional interaction between the elements, or by otherwise relating two elements together. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An apparatus comprising:

a media transport configured to transport a media sheet having marking material on at least a first side of the media sheet;

a media sheet rub module configured to rub a rub material against the first side of the media sheet;

a sensor configured to sense marking material on the rub material, the marking material rubbed from the first side of the media sheet onto the rub material; and a controller configured to determine a fix level of marking material on the media sheet based on the sensed marking material on the rub material, the fix level indicating how well the marking material is affixed to the media sheet;

wherein the controller is configured to determine a fix level of marking material on the media sheet based on a difference between a value corresponding to the sensed marking material on the rub material and a value corresponding to the rub material without marking material.

2. The apparatus according to claim 1, wherein the controller is configured to determine a fix level of marking material on the media sheet by determining a difference between a value corresponding to the sensed marking material on the rub material and a value corresponding to the rub material without marking material and by comparing the difference to a threshold.

3. The apparatus according to claim 1, wherein the sensor is configured to sense a characteristic of rub material without marking material, and wherein the controller is configured to determine a fix level of marking material on the media sheet based on a difference between a value corresponding to the sensed marking material on the rub material and a value corresponding to the sensed characteristic of rub material without marking material.

4. The apparatus according to claim 1, wherein the sensor is configured to sense a level of unrubbed whiteness of rub material without marking material and output a value of unrubbed whiteness, and wherein the sensor is configured to sense a level of rubbed whiteness based on marking material on the rub material rubbed from the first side of the media sheet and output a value of rubbed whiteness.

5. The apparatus according to claim 4, wherein the controller is configured to determine a fix level of marking material on the media sheet based on a difference between the value of unrubbed whiteness and the value of rubbed whiteness.

6. The apparatus according to claim 1, wherein the media sheet rub module includes a backing apparatus coupled to an opposite side of the rub material from the media sheet, the backing apparatus configured to selectively engage the rub material with media sheets and disengage the rub material from media sheets.

7. The apparatus according to claim 1, wherein the controller is configured to determine at least one updated setpoint of at least one actuator in a printing apparatus based on the fix level of marking material on the media sheet.

8. The apparatus according to claim 7, wherein the controller is configured to adjust at least one actuator setpoint based on the at least one updated setpoint.

9. A method in an apparatus having a media transport, a media sheet rub module, and a sensor, the method comprising:

transporting a media sheet on the media transport, the media sheet having marking material on at least a first side of the media sheet;

rubbing a rub material against the first side of the media sheet using the media sheet rub module;

sensing marking material on the rub material using the sensor, the marking material rubbed from the first side of the media sheet onto the rub material; and determining a fix level of marking material on the media sheet based on the sensed marking material on the rub material, the fix level indicating how well the marking material is affixed to the media sheet;

wherein determining comprises determining a fix level of marking material on the media sheet based on a difference between a value corresponding to the sensed marking material on the rub material and a value corresponding to the rub material without marking material.

10. The method according to claim 9, wherein determining comprises determining a fix level of marking material on the media sheet by determining a difference between a value corresponding to the sensed marking material on the rub material and a value corresponding to the rub material without marking material and by comparing the difference to a threshold.

11. The method according to claim 9, further comprising sensing a characteristic of rub material without marking material using the sensor, wherein determining comprises determining a fix level of marking material on the media sheet based on a difference between a value corresponding to the sensed marking material on the rub material and a value corresponding to the sensed characteristic of rub material without marking material.

12. The method according to claim 9, wherein sensing comprises sensing a level of unrubbed whiteness of rub material without marking material and outputting a value of unrubbed whiteness and comprises sensing a level of rubbed whiteness based on marking material on the rub material rubbed from the first side of the media sheet and outputting a value of rubbed whiteness.

13. The method according to claim 12, wherein determining comprises determining a fix level of marking material on the media sheet based on a difference between the value of unrubbed whiteness and the value of rubbed whiteness.

14. The method according to claim 9, wherein the media sheet rub module includes a backing apparatus coupled to an opposite side of the rub material from the media sheet, wherein the method comprises selectively engaging the rub material with media sheets and disengaging the rub material from media sheets using the backing apparatus.

15. The method according to claim 9, wherein determining comprises determining at least one updated setpoint of at least one actuator in a printing apparatus based on the fix level of marking material on the media sheet.

16. The method according to claim 15, further comprising adjusting at least one actuator setpoint based on the at least one updated setpoint.

* * * * *